US005437426A

United States Patent [19]

MacDonald

[11] Patent Number: 5,437,426

[45] Date of Patent: Aug. 1, 1995

[54] BRACKET ARRANGEMENT FOR HANG-ON FURNITURE UNIT

[75] Inventor: Douglas B. MacDonald, Grand Rapids, Mich.

[73] Assignee: Steelcase Inc., Grand Rapids, Mich.

[21] Appl. No.: 82,599

[22] Filed: Jun. 25, 1993

[51] Int. Cl.[6] ..... A47B 96/06

[52] U.S. Cl. ..... 248/222.1; 248/225.2; 248/243

[58] Field of Search ..... 248/222.1, 223.3, 250, 248/225.2, 247, 241, 243; 211/90, 94.5, 153, 192; 108/108, 110

[56] References Cited

U.S. PATENT DOCUMENTS

| | | | |
|---|---|---|---|
| 678,112 | 7/1901 | Callender | 248/247 |
| 2,127,280 | 8/1938 | Zimbalist . | |
| 2,576,865 | 11/1951 | Vanderveld . | |
| 2,741,449 | 4/1956 | Heselov . | |
| 2,845,187 | 7/1958 | Bianchi . | |
| 2,919,034 | 12/1959 | Levy . | |
| 2,971,657 | 2/1961 | Zadek . | |
| 3,054,511 | 9/1962 | Erismann . | |
| 3,087,702 | 4/1963 | Anderson | 248/250 |
| 3,097,822 | 7/1963 | Attwood | 248/250 |
| 3,127,146 | 3/1964 | Fisher . | |
| 3,199,822 | 8/1965 | Ruhnke | 248/250 |
| 3,299,839 | 1/1967 | Nordbak . | |
| 3,325,130 | 6/1967 | Smith et al. . | |
| 3,565,381 | 2/1971 | Oliver | 248/250 X |
| 3,601,432 | 8/1971 | Fenwick et al. . | |
| 3,697,034 | 10/1972 | Shell . | |
| 3,888,440 | 6/1975 | Rebentisch . | |
| 3,966,158 | 6/1976 | Boundy . | |
| 4,018,167 | 4/1977 | Spangler | 248/250 X |
| 4,133,433 | 1/1979 | Wolf . | |
| 4,154,419 | 5/1979 | Breidenbach . | |
| 4,171,789 | 10/1979 | Vander Hoek et al. . | |
| 4,198,913 | 4/1980 | Haworth et al. . | |
| 4,205,815 | 6/1980 | Saver et al. | 211/192 X |
| 4,222,542 | 9/1980 | Wilson et al. . | |
| 4,324,379 | 4/1982 | Ovitz, III . | |
| 4,378,925 | 4/1983 | Griffin | 248/248 X |
| 4,406,374 | 9/1983 | Yedor . | |
| 4,541,599 | 9/1985 | Schoumaker . | |
| 4,660,477 | 4/1987 | Kortering et al. . | |
| 4,671,481 | 6/1987 | Beard . | |
| 4,700,916 | 10/1987 | Bastian et al. . | |
| 4,971,281 | 11/1990 | Steinbeck . | |
| 5,022,621 | 6/1991 | Quest . | |
| 5,063,715 | 11/1991 | Goodman . | |
| 5,116,007 | 5/1992 | Von Gunton et al. . | |

*Primary Examiner*—Ramon O. Ramirez
*Assistant Examiner*—Korie H. Chan
*Attorney, Agent, or Firm*—Price, Heneveld, Cooper, DeWitt & Litton

[57] ABSTRACT

A furniture arrangement includes a hang-on furniture unit such as a worksurface, an upright support such as an office partition panel, and a system of brackets adapted to lockingly engage the upright support and support the hang-on furniture unit. The system of brackets includes a cantilever bracket with teeth adapted to engage slots in the upright support, and an upper edge for supporting the hang-on furniture unit. The system of brackets further includes a locking bracket adapted with second teeth, the first and second teeth being adapted to form an interlocking arrangement in the slots in the upright support. The locking bracket also includes a safety tab that engages a tab mount on the upper edge of the cantilever bracket, the safety tab being configured so that the second teeth must be properly located in the slots in order to allow the safety tab to engage the tab mount. The hang-on furniture unit is attached to the cantilever bracket and the locking bracket to form a rigid unit that cannot be inadvertently disengaged from the upright support. The locking bracket is reversible to minimize the number of parts that must be used.

26 Claims, 2 Drawing Sheets

BRACKET ARRANGEMENT FOR HANG-ON FURNITURE UNIT

BACKGROUND OF THE INVENTION

The present invention relates to office furniture, and in particular to a bracket arrangement for hang-on furniture units and the like which prevents inadvertent disengagement of the furniture unit from a support therefor.

In partition panel systems and the like, worksurfaces, shelves, and other hang-on furniture articles are often supported by brackets that releasably attach to slots in vertical structural members of the partition panels. In such case, locking members are often attached to the worksurface and/or the partition panels to prevent inadvertent disengagement of the brackets. However, it is usually possible to assemble the worksurfaces to the partition panels and brackets without using the locking members, thus defeating the purpose of the locking members. Also it is often possible to incorrectly assemble the locking members such that they do not perform their intended function. Further, many of these locking members are not reversible and thus require separate right hand and left hand parts. Also, there are spacial problems where adjacent parts interfere with each other, such as when it is desired to position worksurfaces adjacent each other at the same height. Still further, many known locking members require cumbersome installation and/or multiple fasteners.

Thus, a worksurface support and system of brackets is desired solving the aforementioned problems.

SUMMARY OF THE INVENTION

In one aspect, the invention includes a furniture arrangement comprising a hang-on furniture unit, an upright support adapted to support the hang-on furniture unit, and a cantilever bracket including first and second orthogonal edges, the first orthogonal edge including first teeth adapted to engage the upright support, and the second orthogonal edge including a first retainer and also being adapted to support the hang-on furniture unit. The furniture arrangement further includes a locking bracket including a second retainer adapted to securely engage the first retainer on the cantilever bracket to retain the locking bracket to the cantilever bracket. The locking bracket further includes second teeth adapted to engage the support and form an interlocking arrangement with the first teeth when the second retainer is engaged with the first retainer so that the locking bracket and the cantilever bracket cannot be removed as a unit from the support. The cantilever bracket includes a first attachment flange and the locking bracket includes a second attachment flange for attachment to the hang-on furniture unit, whereby the cantilever bracket and the locking bracket can be attached to the hang-on furniture unit to form an interconnected unit that is interlockingly retained to the upright support and thus which cannot be inadvertently disengaged from the upright support.

In another aspect, the invention includes a mounting system for supporting a hang-on furniture unit on an upright support. The mounting system includes a cantilever bracket including first and second edges, the first edge including first engaging means for engaging slots in the upright support and the second edge including a first detachable retainer and being adapted to support the worksurface. The bracket system also includes a locking bracket including a second detachable retainer adapted to engage the first detachable retainer to retain the locking bracket to the cantilever bracket. The locking bracket further includes second engaging means for engaging slots in the upright support, and a fastener-receiving flange for securing the locking bracket to the worksurface. The second engaging means forms an interlocking arrangement with the first engaging means in the slots which locks the cantilever bracket and the locking bracket in the slots when the second retainer is engaged with the first retainer. The interlocking arrangement prevents inadvertent dislodgement of the cantilever bracket from the slots.

Preferably, the locking bracket is reversible, and can be installed on either side of the cantilever bracket.

An object of the present invention is to provide a hang-on furniture unit support in which a cantilever bracket and a locking bracket cooperatively engage an upright support to support a hang-on furniture unit, but also engage the upright support in a manner so that the hang-on furniture unit cannot be inadvertently disengaged from the upright support.

Another object of the present invention is to provide a bracket system wherein a locking bracket can not be left off of the assembly or mis-installed.

Another object of the present invention is to reduce the number of parts required to provide an interlocking arrangement for securely interlocking a worksurface to an upright support.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
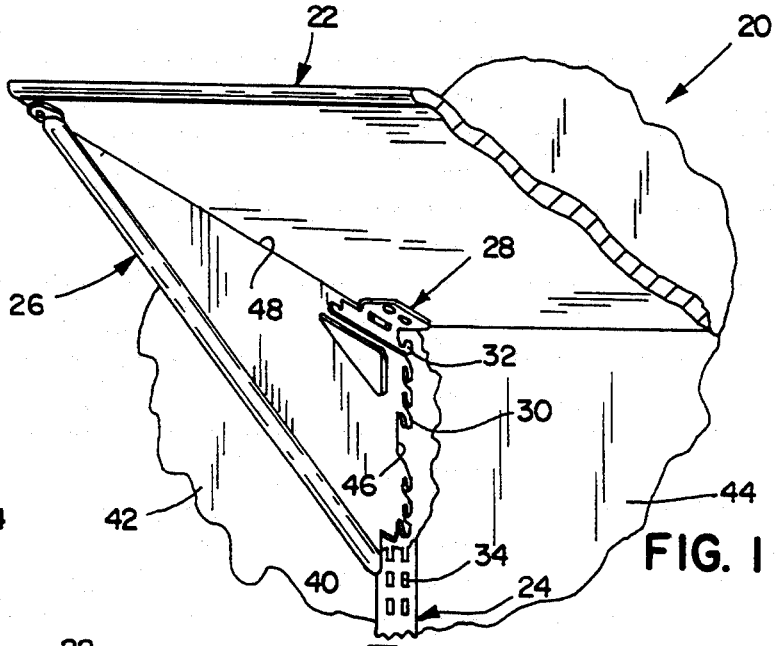
FIG. 1 is a fragmentary bottom perspective view of a furniture arrangement embodying the present invention.

A furniture arrangement 20 (FIG. 1) embodying the present invention includes a hang-on furniture unit such as the illustrated worksurface 22, an upright support 24 such as an office partition panel system, and a mounting system including a cantilever bracket 26 and a locking bracket 28 for supporting the worksurface 22 on the upright support 24. Brackets 26 and 28 include teeth 30 and 32, respectively, adapted to lockingly engage slots 34 in upright support 24, and further include a tab mount or retainer 36 and safety tab or retainer 38, respectively (FIG. 4), that engage each other to provide a secure interconnection. The brackets 26 and 28 are connected to worksurface 22 and form a rigid unit therewith which rigid unit is interlocked to the upright support 24 and cannot be inadvertently disengaged from upright support 24, as described below.

The illustrated upright support 24 (FIG. 1 ) is part of an office partition panel system. Upright support 24 includes a vertical metal strip 40 with two vertical rows of slots 34 for releasably mounting various items to the panel system. The slots 34 are oriented vertically, and the two rows are spaced horizontally apart a small distance. The panel system also includes partition panels 42 and 44 that are arranged along with other partition panels (not shown) to divide an office layout into workstations and the like. The partition panels 42 and 44 can also provide a back surface for worksurface 22.

Figure 2:
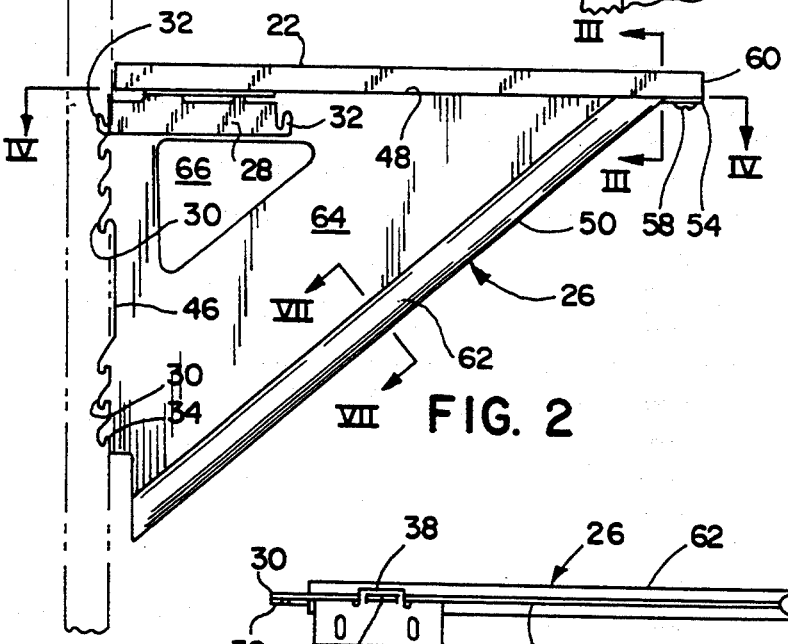
FIG. 2 is a side view of the furniture arrangement illustrated in FIG. 1.
Figure 3:
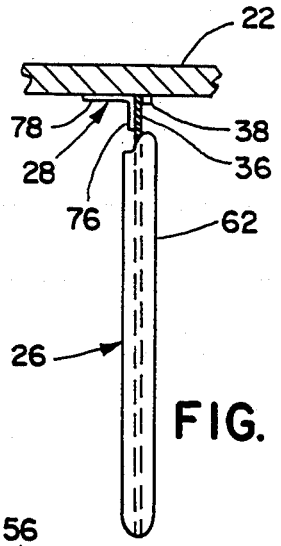
FIG. 3 is a cross-sectional view taken along the lines III—III in FIG. 2 with the cantilever bracket being partially broken-away.
Figure 8:
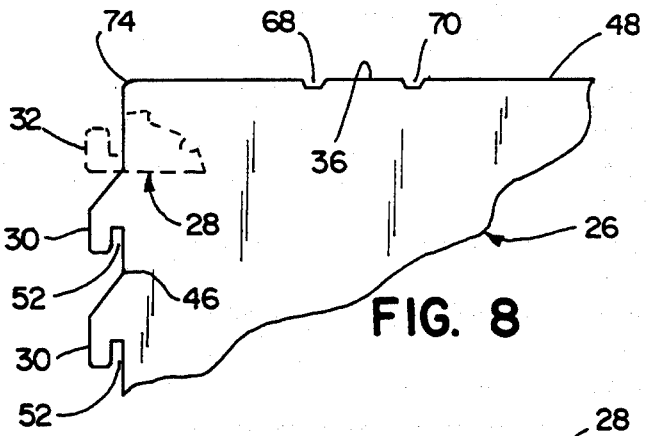
FIG. 8 is a fragmentary side view of the cantilever bracket.

Cantilever bracket 26 (FIG. 2) is a generally planar triangularly-shaped bracket having orthogonal sides or edges 46 and 48 and an angled side or edge 50. The vertically positioned orthogonal side 46 includes teeth 30 that define a downwardly oriented notch 52 (FIG. 8). Teeth 30 are spaced apart and shaped to securely engage selected slots 34 (FIGS. 1 and 2). With teeth 30 securely engaged in slots 34, orthogonal side 48 is positioned horizontally such that worksurface 22 can be stably supported thereon. A flange 54 located on the outer end of orthogonal side 48 includes an aperture 56 for receiving a fastener such as a screw 58 for securing the outer edge 60 of worksurface 22 to cantilever bracket 26. A tubular member 62 is integrally formed along angled side 50 to provide increased strength to cantilever bracket 26. Tubular member 62 also provides a blunted surface that does not include corners or sharp edges. Tubular member 62 thus creates a "friendly" environment for an operator's knees. Also, tubular member 62 can be readily formed along side 50 and thus facilitates efficient manufacture without multiple secondary operations such as bending, welding, or reinforcing. The triangularly-shaped body 64 of cantilever bracket 26 is a planar sheet of metal, with cutouts 66 being provided therein to reduce weight and to provide an aesthetic appearance as desired. The upper orthogonal side 48 includes a pair of spaced apart notches 68 and 70 (FIG. 8) which define tab mount 36, tab mount 36 being located near to but spaced from the corner 74 joining orthogonal sides 46 and 48.

Figure 9:
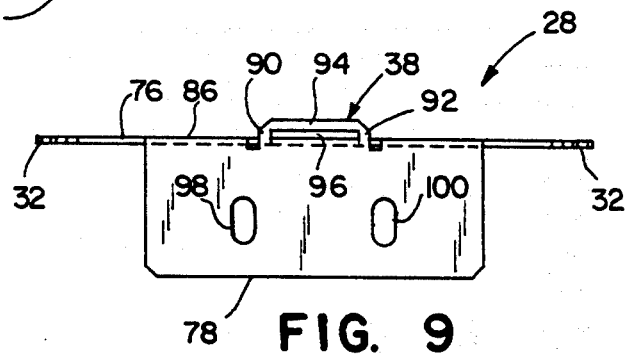
FIG. 9 is a top view of the locking bracket.
Figure 10:
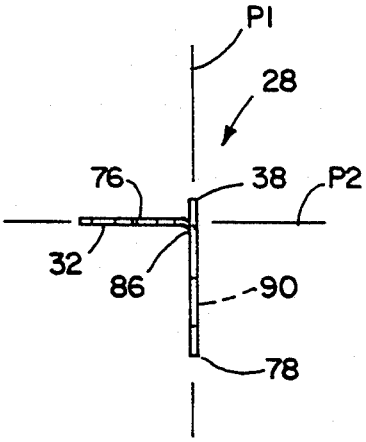
FIG. 10 is a side view of the locking bracket.
Figure 11:
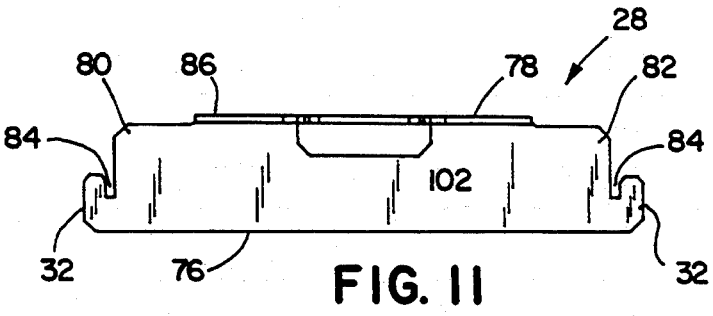
FIG. 11 is an end view of the locking bracket.

Locking bracket 28 (FIGS. 9–11) is an L-shaped bracket stamped from sheet metal. Locking bracket 28 includes a first leg 76 and a second leg 78 that extends perpendicularly to first leg 76. First leg 76 includes a tooth 32 at each end 80 and 82. Teeth 32 are oriented upwardly so as to form upwardly facing notches 84. Second leg 78 extends generally horizontally from first leg 76, and is connected to first leg 76 along a bend or line of joinder 86. Midway along bend 86 is safety tab 38. Safety tab 38 extends in a plane P1 (FIG. 10) defined by second leg 78, but extends through a plane P2 defined by first leg 76 to the other side of first leg 76. In other words, safety tab 38 extends away from second leg 78 to the opposite side of first leg 76 (FIG. 10). Safety tab 38 (FIG. 9) includes a pair of sections 90 and 92 connected by a section 94, sections 90, 92 and 94 defining an aperture 96 with second leg 78. Aperture 96 is shaped to closely receive tab mount 36 (FIG. 8), and notches 68 and 70 are shaped to closely receive tab sections 90 and 92. With safety tab 38 engaging tab mount 36, locking bracket tooth 32 (shown in phantom in FIG. 8) is positioned in an opposing relationship to cantilever bracket tooth 30. Second leg 78 also includes apertures 98 and 100 for receiving fasteners such as screws for securing locking bracket 28 to worksurface 22. Notably, in the embodiments shown, safety tab 38 is stamped from material originally forming part of first leg 76, thus leaving an aperture 102 in first leg 76. However, it is contemplated that a number of differently shaped safety tabs and tab mounts could be formed. Also, it is contemplated that the safety tab and tab mount need not necessarily be located at the top of the brackets 26 and 28.

Cantilever bracket 26 (FIG. 2) is installed by inserting teeth 30 into selected slots 34 and then pressing cantilever bracket 26 downwardly. Thus, teeth 30 fully engage the selected slots 34 in upright support 24. The locking bracket 28 can then be installed by holding locking bracket 28 at an angle and inserting tooth 32 into a selected slot 34. As locking bracket 28 is rotated downwardly to a horizontal position, tab mount 36 slideably engages the aperture 96 in safety tab 38, and tab sections 90 and 92 engage notches 68 and 70 in upper edge 48 of cantilever bracket 26. When fully installed, teeth 30 and 32 form an interlocking arrangement, with teeth 30 being oriented generally downwardly and tooth 32 being oriented generally upwardly. Thus, cantilever bracket 26 and locking bracket 28 cannot be removed as a unit. Notably, with locking bracket 28 installed on cantilever bracket 26, the upper edge of the assembled pieces form substantially a flat surface for receiving worksurface 22.

Once cantilever bracket 26 and locking bracket 28 are inserted into selected slots 34 and fully seated therein and also fully seated against each other, worksurface 22 is attached to the brackets by fasteners that engage apertures 56, 98 and 100 to thus form a rigid unit. Notably, the presence of worksurface 22 prevents safety tab 38 from disengaging front tab mount 36. Also, the interconnection of worksurface 22 to cantilever bracket 26 and locking bracket 28 prevents teeth 30 and 32 from releasing from slots 34. Still further, the engagement of safety tab 38 with tab mount 36 provides a readily assembleable mounting system that is secure and which cannot be mis-assembled. In particular, first leg 76 abuts the side of cantilever bracket body 64 in a cantilever-like manner which prevents skewing of locking bracket 28 relative to cantilever bracket 26.

Figure 5:
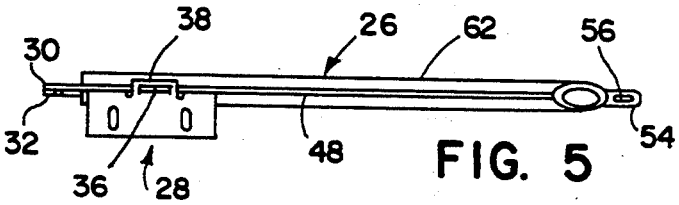
FIG. 5 is a top view comparable to FIG. 4 but with the locking bracket mounted in a reversed position on the opposite side of the cantilever bracket.
Figure 4:
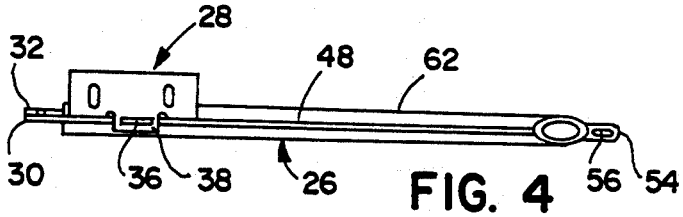
FIG. 4 is a top view of the cantilever bracket and the locking bracket illustrated in FIG. 1.
Figure 6:
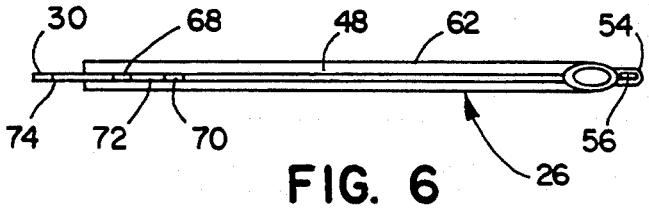
FIG. 6 is a top view of the cantilever bracket.
Figure 7:
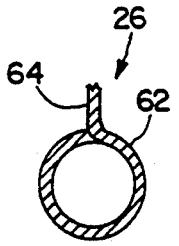
FIG. 7 is a cross-sectional view taken along the lines VII—VII in FIG. 2.

Notably, locking bracket 28 is reversible and can be installed on either side of cantilever bracket 26 (FIGS. 4 and 5). This allows a single type locking bracket to be used on either side of the worksurface. It also allows locking bracket 28 to be used in a confined area, such as where two worksurfaces will be positioned adjacent each other and in a pair of slots 34 located close together side by side (see FIG. 1). Due to safety tab 38 of locking bracket 28, it is unlikely that locking bracket 28 can be incorrectly installed onto cantilever bracket 26.

Thus, a furniture arrangement is provided that includes a hang-on furniture unit, an upright support, and a mounting system of brackets, the mounting system including a cantilever bracket adapted to support the hang-on furniture unit on the upright support and further including a locking bracket adapted to securely engage the support, the worksurface and the cantilever bracket in a manner that interlocks the hang-on furniture unit to the support. Further, the locking bracket is configured to prevent mis-assembly, and is also reversible.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A furniture arrangement comprising:

a hang-on furniture unit;

an upright support including slots adapted to support said hang-on furniture unit;

a cantilever bracket including first and second generally orthogonal edges, said first orthogonal edge including first teeth adapted to engage selected slots in said upright support, said orthogonal edge being adapted to support said hang-on furniture unit, said second orthogonal edge including a first retainer;

a locking bracket including a second retainer adapted to securely engage said first retainer to retain said locking bracket to said cantilever bracket, said locking bracket further including second teeth adapted to engage said selected slots in said upright support and form an interlocking arrangement with said first teeth when said second retainer is engaged with said first retainer, said first and second teeth extending in opposite directions so that said locking bracket and said cantilever bracket cannot be removed as a unit from said support; and said cantilever bracket including a first attachment flange and said locking bracket including a second attachment flange for attachment to said hang-on furniture unit, said first attachment flange being substantially coplanar with said second attachment flange whereby said cantilever bracket and said locking bracket can be attached to said hang-on furniture unit to form an interconnected unit that is interlockingly retained to said upright support and thus which cannot be inadvertently disengaged from said upright support.

2. A furniture arrangement as defined in claim 1 wherein one of said first and second retainers includes an aperture for receiving the other of said first and second retainers.

3. A furniture arrangement as defined in claim 2 wherein said locking bracket defines an L-shape when viewed from an end including a first leg and a second leg, said first leg including said second teeth and said second leg including said second attachment flange.

4. A furniture arrangement as defined in claim 3 wherein said second leg defines a plane and said second retainer extends parallel said plane.

5. A furniture arrangement as defined in claim 4 wherein said cantilever bracket is generally triangularly-shaped.

6. A furniture arrangement as defined in claim 1 wherein said locking bracket defines an L-shape and includes a first leg including said second teeth and a second leg including said second attachment flange.

7. A furniture arrangement as defined in claim 1 wherein said locking bracket is reversible and is configured so that said locking bracket can be mounted on either side of said cantilever bracket.

8. A furniture arrangement as defined in claim 1 wherein said cantilever bracket includes a third edge connecting said first and second edges, said third edge including a tubular member formed therealong.

9. A furniture arrangement as defined in claim 8 wherein said tubular member is integrally formed as part of said cantilever bracket.

10. A furniture arrangement as defined in claim 9 wherein said cantilever bracket and tubular member are formed from a single blank of sheet metal.

11. A furniture arrangement comprising:

a hang-on furniture unit;

an upright support adapted to support said hang-on furniture unit;

a cantilever bracket including first and second generally orthogonal edges, said first orthogonal edge including first teeth adapted to engage said upright support, said second orthogonal edge being adapted to support said hang-on furniture unit, said second orthogonal edge including a first retainer;

a locking bracket including a second retainer adapted to securely engage said first retainer to retain said locking bracket to said cantilever bracket, said locking bracket further including second teeth adapted to engage said upright support and form an interlocking arrangement with said first teeth when said second retainer is engaged with said first retainer so that said locking bracket and said cantilever bracket cannot be removed as a unit from said support, one of said first and second retainers including an aperture for receiving the other of said first and second retainers, said locking bracket defining an L-shape when viewed from an end including a first leg and a second leg, said first leg including said second teeth, said second leg defining a plane and said second retainer extending parallel said plane;

said cantilever bracket including a first attachment flange and said locking bracket including a second attachment flange on said second leg for attachment to said hang-on furniture unit, whereby said cantilever bracket and said locking bracket can be attached to said hang-on furniture unit to form an interconnected unit that is interlockingly retained to said upright support and thus which cannot be inadvertently disengaged from said upright support, said cantilever bracket being generally triangularly-shaped; and said locking bracket including third teeth positioned on an end opposite said second teeth, said third teeth being adapted to engage said upright support and form an interlocking arrangement with said first teeth, whereby said locking bracket is reversible and can be positioned on either side of said cantilever bracket.

12. A furniture arrangement as defined in claim 11 wherein a third edge of said cantilever bracket includes a tubular reinforcement.

13. A furniture arrangement comprising:

a hang-on furniture unit;

an upright support adapted to support said hang-on furniture unit:

a cantilever bracket including first and second generally orthogonal edges, said first orthogonal edge including first teeth adapted to engage said upright support, said second orthogonal edge being adapted to support said hang-on furniture unit, said second orthogonal edge including a first retainer;

a locking bracket including a second retainer adapted to securely engage said first retainer to retain said locking bracket to said cantilever bracket, said locking bracket further including second teeth adapted to engage said upright support and form an interlocking arrangement with said first teeth when said second retainer is engaged with said first retainer so that said locking bracket and said cantilever bracket cannot be removed as a unit from said support, said locking bracket defining an L-shape and having a first leg including said second teeth and having a second leg, said second retainer including a tab located proximate the intersection of said first and second legs; and said cantilever bracket including a first attachment flange and said locking bracket including a second attachment flange on said second leg for attachment to said hang-on furniture unit, whereby said cantilever bracket and said locking bracket can be attached to said hang-on furniture unit to form an interconnected unit that is interlockingly retained to said upright support and thus which cannot be inadvertently disengaged from said upright support.

14. A furniture arrangement comprising:

a hang-on furniture unit;

an upright support adapted to support said hang-on furniture unit;

a cantilever bracket including first and second generally orthogonal edges, said first orthogonal edge including first teeth adapted to engage said upright support, said second orthogonal edge being adapted to support said hang-on furniture unit, said second orthogonal edge including a first retainer;

a locking bracket including a second retainer adapted to securely engage said first retainer to retain said locking bracket to said cantilever bracket, said locking bracket further including second teeth adapted to engage said upright support and form an interlocking arrangement with said first teeth when said second retainer is engaged with said first retainer so that said locking bracket and said cantilever bracket cannot be removed as a unit from said support, said locking bracket defining an L-shape and having a first leg including said second teeth and having a second leg, said second retainer including a tab located on one side of said first leg, said second leg being located on another side of said first leg opposite said one side; and said cantilever bracket including a first attachment flange and said locking bracket including a second attachment flange on said second leg for attachment to said hang-on furniture unit, whereby said cantilever bracket and said locking bracket can be attached to said hang-on furniture unit to form an interconnected unit that is interlockingly retained to said upright support and thus which cannot be inadvertently disengaged from said upright support.

15. A furniture arrangement comprising:

a hang-on furniture unit;

an upright support adapted to support said hang-on furniture unit;

a cantilever bracket including first and second generally orthogonal edges, said first orthogonal edge including first teeth adapted to engage said upright support, said second orthogonal edge being adapted to support said hang-on furniture unit, said second orthogonal edge including a first retainer;

a locking bracket including a second retainer adapted to securely engage said first retainer to retain said locking bracket to said cantilever bracket, said locking bracket further including second teeth adapted to engage said upright support and form an interlocking arrangement with said first teeth when said second retainer is engaged with said first retainer so that said locking bracket and said cantilever bracket cannot be removed as a unit from said support;

said cantilever bracket including a first attachment flange and said locking bracket including a second attachment flange for attachment to said hang-on furniture unit, whereby said cantilever bracket and said locking bracket can be attached to said hang-on furniture unit to form an interconnected unit that is interlockingly retained to said upright support and thus which cannot be inadvertently disengaged from said upright support; and said locking bracket defining an L-shape and having a first leg including said second teeth and having a second leg including said second attachment flange, said first leg including an end having said second teeth and including another end having third teeth configured as a mirror-image of said second teeth, and said second retainer being adapted to engage said first retainer from either side of said cantilever bracket, whereby said locking bracket is reversible.

16. In a furniture arrangement of the type including a hang-on furniture unit and an upright support therefor, the upright support having slots, the improvement of a mounting system, comprising:

a fastener for securing said hang-on furniture unit to said mounting system;

a cantilever bracket including first and second edges, said first edge including first engaging means for engaging selected slots in the upright support and said second edge being adapted to support the worksurface, said second edge including a first detachable retainer; and a locking bracket including a second detachable retainer adapted to engage said first detachable retainer to retain said locking bracket to said cantilever bracket when the worksurface is secured to said cantilever bracket, said locking bracket including second engaging means for engaging selected slots in the upright support and further including a fastener-receiving flange which receives said fastener for securing said locking bracket to the worksurface, said second extending and engaging means engaging said selected slots in an Opposite direction from said first engaging means so that said second engaging means forms an interlocking arrangement with said first engaging means which locks said first engaging means on the slots when said first detachable retainer is engaged with said second detachable retainer, said interlocking arrangement preventing inadvertent dislodgement of said cantilever bracket and said locking bracket from the slots.

17. A mounting system of the type including a hang-on furniture unit and an upright support therefor, the upright support having slots, the improvement of a mounting system, comprising:

a fastener for securing said hang-on furniture unit to said mounting system;

a cantilever bracket including first and second edges, said first edge including first engaging means for engaging selected slots in the upright support and said second edge being adapted to support the worksurface, said second edge including a first detachable retainer; and a locking bracket including a second detachable retainer adapted to engage said first detachable retainer to retain said locking bracket to said cantilever bracket when the worksurface is secured to said cantilever bracket, said locking bracket including second engaging means for engaging selected slots in the upright support and further including a fastener-receiving flange which receives said fastener for securing said locking bracket to the worksurface, said second engaging means forming an interlocking arrangement with said first engaging means which locks said first engaging means on the slots when said first detachable retainer is engaged with said second detachable retainer, said interlocking arrangement preventing inadvertent dislodgement of said cantilever bracket and said locking bracket from the slots, said locking bracket defining an L-shape that includes a first leg including said second engaging means and a second leg including said fastener-receiving flange.

18. A mounting system as defined in claim 17 wherein said second detachable retainer includes a tab located proximate the intersection of said first and second legs.

19. A mounting system as defined in claim 17 wherein said second detachable retainer includes a tab located on one side of said first leg, said second leg being located on another side of said first leg.

20. A mounting system as defined in claim 17 wherein said first engaging means includes first teeth, and said second engaging means includes second teeth and third teeth located at opposing ends of said locking bracket, said third teeth being configured as a mirror-image of said second teeth, said first and second detachable retainers being configured to engage with said locking bracket located on either side of said cantilever bracket, whereby said locking bracket is reversible.

21. A mounting system of the type including a hang-on furniture unit and an upright support therefor, the upright support having slots, the improvement of a mounting system, comprising:

a fastener for securing said hang-on furniture unit to said mounting system;

a cantilever bracket including first and second edges, said first edge including first engaging means for engaging selected slots in the upright support and said second edge being adapted to support the worksurface, said second edge including a first detachable retainer; and a locking bracket including a second detachable retainer adapted to engage said first detachable retainer to retain said locking bracket to said cantilever bracket when the worksurface is secured to said cantilever bracket, said locking bracket including second engaging means for engaging selected slots in the upright support and further including a fastener-receiving flange which receives said fastener for securing said locking bracket to the worksurface, said second engaging means forming an interlocking arrangement with said first engaging means which locks said first engaging means on the slots when said first detachable retainer is engaged with said second detachable retainer, said interlocking arrangement preventing inadvertent dislodgement of said cantilever bracket and said locking bracket from the slots, said locking bracket being configured so that said locking bracket can be mounted on either one of an opposite sides of said cantilever bracket.

22. A mounting system for a furniture arrangement including a hang-on furniture unit and a support for the hang-on furniture unit, comprising:

a cantilever bracket adapted to support the hang-on furniture unit including means for securely releasably engaging the support and means for supporting the worksurface, said cantilever bracket including a tab mount; and a locking bracket including a first leg positioned adjacent said cantilever bracket, a second leg extending perpendicular to said first leg, and a safety tab extending parallel said second leg for detachably engaging said tab mount, said locking bracket including means engaging the support for locking said cantilever bracket to the support and means for attaching to the hang-on furniture unit, said safety tab being configured so that said safety tab must be properly engaged with said tab mount and said means for locking must be properly engaged with the support in order to attached the worksurface to the cantilever bracket and the locking bracket, said means for engaging the support on said cantilever bracket and said locking bracket extending in opposite directions and forming an interlocking arrangement in the support.

23. A mounting system as defined in claim 22 wherein said locking bracket is configured so that said locking bracket can be mounted on either side of said cantilever bracket.

24. A mounting system as defined in claim 23 wherein one of said safety tab and said tab mount includes an aperture for engaging the other of said safety tab and said tab mount.

25. A system of brackets comprising:

a generally planar triangularly-shaped bracket including a first edge having downwardly oriented teeth thereon adapted to engage slots in a support, said triangularly-shaped bracket further including a second edge adapted to support a hang-on furniture unit, said second edge including a flange adapted for secure attachment to the hang-on furniture unit and also including a tab mount; and an L-shaped bracket including a first leg having upwardly oriented teeth thereon adapted to engage slots in a support and further including a second leg adapted for secure attachment to the hang-on furniture unit, said L-shaped bracket including a safety tab defining an aperture for engaging said tab mount; said safety tab, said upwardly oriented teeth and said second leg being located with respect to each other so that, when said safety tab is engaged with said tab mount, said upwardly oriented teeth are positioned for engagement with the slots in the support and said second leg is positioned for engagement with the worksurface.

26. A method comprising:

providing an upright support with slots, a cantilever bracket including first teeth adapted to engage the slots and extending in a first direction and further including a tab mount, a locking bracket including a safety tab adapted to engage the tab mount and further including second teeth adapted to engage the slots in a second direction opposite the first direction and form an interlocking arrangement with the first teeth, and a hang-on furniture unit including a fastener for securing said hang-on furniture unit to said locking bracket;

attaching the cantilever bracket to the upright support by engaging the first teeth in the slots in said first direction;

attaching the locking bracket to the upright support by engaging the second teeth in the slots in said second direction and attaching the locking bracket to the cantilever bracket by engaging the safety tab on the tab mount; and attaching the hang-on furniture unit to the cantilever bracket and to the locking bracket using said fastener to form an interconnected unit, which interconnected unit cannot be inadvertently disengaged from the upright support due to the interlocking arrangement formed in the slots by the first and second teeth.

* * * * *

UNITED STATES PATENT AND TRADEMARK OFFICE

CERTIFICATE OF CORRECTION

PATENT NO. : 5,437,426

DATED : August 1, 1995

INVENTOR(S) : Douglas B. MacDonald

It is certified that error appears in the above-indentified patent and that said Letters Patent is hereby corrected as shown below:

Column 4, line 41;

"front" should be --from--.

Column 11, line 3;

After "slots" insert --and extending--.

Signed and Sealed this

Thirty-first Day of October 1995

*Attest:*

*Attesting Officer*

BRUCE LEHMAN

*Commissioner of Patents and Trademarks*